US005186565A

United States Patent [19]

Jack

[11] Patent Number: 5,186,565

[45] Date of Patent: Feb. 16, 1993

[54] SLIDING RING MOUNT FOR A POCKET BINDER

[75] Inventor: Douglas M. Jack, Los Angeles, Calif.

[73] Assignee: Day Runner, Inc., Fullerton, Calif.

[21] Appl. No.: 927,830

[22] Filed: Aug. 7, 1992

[51] Int. Cl.[5] ..... B42F 13/00; B42F 13/40

[52] U.S. Cl. ..... 402/79; 281/15.1; 281/16; 281/31; 281/38; 283/65; 402/78; 402/80 R

[58] Field of Search ..... 281/15.1, 16, 19.1, 281/31, 32, 34, 38; 283/65; 402/78, 79, 80 R

[56] References Cited

U.S. PATENT DOCUMENTS

| | | | |
|---|---|---|---|
| 217,733 | 7/1879 | Ellsworth | 281/15.1 |
| 392,066 | 10/1888 | Razall | 281/16 |
| 470,861 | 3/1892 | Chichester | 281/31 X |
| 575,809 | 1/1897 | O'Riva | 281/31 |
| 1,492,932 | 5/1924 | Orrell | 283/65 X |
| 1,574,838 | 3/1926 | Moore | 402/79 X |
| 2,431,472 | 9/1945 | Fistell | 150/39 |
| 2,467,616 | 2/1946 | Sziklai | 281/32 |
| 2,467,656 | 11/1947 | Broughton | 281/19 |
| 3,537,728 | 2/1968 | Reese | 281/31 |
| 4,170,423 | 10/1979 | Bourbon | 402/70 |
| 4,355,822 | 10/1982 | McHugh | 281/34 |
| 4,420,112 | 12/1983 | Cline | 281/31 X |
| 4,573,821 | 2/1986 | Gilreath | 402/78 |
| 4,660,855 | 4/1987 | Pagliaccio | 281/2 |
| 4,723,861 | 2/1988 | Merchant | 402/8 |
| 4,784,508 | 11/1988 | Shannon | 402/79 |
| 4,838,724 | 6/1989 | Spence, Jr. | 402/79 |
| 4,850,731 | 7/1989 | Youngs | 402/79 |
| 4,892,333 | 1/1990 | Krulich | 281/15.1 |
| 4,893,839 | 1/1990 | Podd et al. | 283/65 |
| 4,907,904 | 3/1990 | Baldwin | 402/80 R |
| 4,971,361 | 11/1990 | Whiting | 281/2 |
| 4,972,952 | 11/1990 | Reiseneder | 402/79 X |
| 5,048,869 | 9/1991 | Schwartz | 281/16 |
| 5,114,259 | 5/1992 | Meservy et al. | 402/80 R |
| 5,141,253 | 8/1992 | Rice | 281/15.1 X |

FOREIGN PATENT DOCUMENTS

| | | | |
|---|---|---|---|
| 215159 | 4/1967 | Sweden | 281/16 |

*Primary Examiner*—Paul A. Bell

*Attorney, Agent, or Firm*—Pretty, Schroeder, Brueggeman & Clark

[57] ABSTRACT

A pocket binder with a ring mount slidably seated in a compartment between the panels of the binder cover for attachment to a ringed binder. The ring mount may be partially extended from the compartment to expose a plurality of holes for insertion in a ringed binder. Alternatively, the ring mount may be retracted into the compartment to reduce the width of the pocket binder to a size capable of being stored in a suit pocket. A second embodiment discloses a pocket binder and ringed binder combination with the pocket binder attached to the ringed binder by the insertion of the rings through the holes in the pocket binder.

24 Claims, 3 Drawing Sheets

SLIDING RING MOUNT FOR A POCKET BINDER

BACKGROUND OF THE INVENTION

The present invention relates to inserts for binders and, more particularly, to a pocket insert with a retractable mount for use in a ringed binder.

A typical pocket binder includes a front panel, a back panel and a spine positioned therebetween. Often a calculator or other article is mounted in the interior of the pocket binder on one side and the other side is provided with pockets for holding pads of paper, checkbooks or other relatively flat items. When folded, many such binders are small enough to be conveniently stored in a suit pocket, hence the term "pocket binder."

Pocket binders commonly lack means by which they may be conveniently and satisfactorily secured to a ringed binder. Usually, they are not provided with holes through which the rings of a binder can be inserted. If holes were pierced through the front panel or the back panel of a pocket binder, then space in the interior of the pocket binder would be lost to accommodate the holes and the rings of the ringed binder. Furthermore, if an extension were attached to the side of a conventional pocket binder, in which holes were provided, the size of the pocket binder would no longer be as suitable for storage in a suit pocket. Therefore, it is desirable to have a convenient and highly effective pocket binder that is adapted for placement in a ringed binder and will fit in a small pocket.

SUMMARY OF THE INVENTION

The present invention provides a pocket binder with a ring mount slidably seated in a compartment between the panels of the binder cover. The pocket binder is readily secured within a conventional ringed binder, but its size is kept to a minimum for easy storage.

When the ring mount is in a partially extended position, a plurality of holes located on the side of the ring mount are exposed. The pocket binder may then be inserted in a ringed binder by opening the binder rings and passing the rings through the corresponding holes in the ring mount. When the pocket binder is stored in a pocket or otherwise used apart from a ringed binder, the ring mount may be retracted such that the mount is fully seated within the compartment. Accordingly, when the ring mount is in its retracted position, the pocket binder is small enough to be conveniently stored in a suit pocket and is no larger than necessary.

Specifically, the present invention comprises a pocket binder for use with a ringed binder having rings. The pocket binder includes a cover having an exterior panel and an interior panel; the cover having a compartment formed by the space between the exterior panel and the interior panel, with the compartment being accessible through an opening along a first longitudinal edge of the cover. The pocket binder further includes a ring mount slidably seated within the compartment, the ring mount having a first longitudinal portion defining a plurality of holes adapted for engagement with the rings of the ringed binder and means for retaining a second portion of the ring mount in the compartment when the first portion of the ring mount is extended from the compartment.

In a preferred embodiment of the invention, the pocket binder has a right side, a left side and a spine positioned between the sides. Each side has an exterior panel and an interior panel and a ring mount is slidably seated in a compartment formed between the panels of the right side. A calculator, or other article, is mounted on the interior panel of the left side of the pocket binder and protected by the binder cover when the pocket binder is closed. Further, in this embodiment, the combined width of the pocket binder right side, left side and spine is greater than the width of one side of a conventional ringed binder. In this manner, when the pocket binder is retained in a conventional ringed binder and the pocket binder is opened, the left side of the pocket binder will extend beyond the periphery of the ringed binder and the calculator will be accessible when the ringed binder is closed.

In a further embodiment, the ring mount includes a pair of shoulders located on opposing sides of the ring mount to the outside of and behind the ring holes. Flanges are added to opposing sides of the compartment opening. The ring mount is retained in the compartment when the ring mount is partially extended from the compartment because the ring mount shoulders abut the flanges when the ring holes are exposed. This structure retains the portion of the ring mount behind the shoulders in the compartment even though a portion of it, including the ring holes, is extended from the compartment. Yet a further embodiment of the present invention comprises a pocket binder and ringed binder combination. The ringed binder has openable rings for engaging the holes of the ring mount of the pocket binder.

BRIEF DESCRIPTION OF THE DRAWINGS

These and other features of the present invention may be more fully understood from the following detailed description, accompanying drawings, wherein similar reference characters referred to similar elements throughout and in which.

DETAILED DESCRIPTION OF THE INVENTION

As illustrative embodiment of the present invention is disclosed herein; however, it is merely representative, recognizing that various structural elements may be embodied in a wide variety of forms, some of which may be quite different from those specific structural details disclosed herein. Consequently, the details disclosed herein are merely representative; yet in that regard they are deemed to afford the best embodiment and to provide a basis for the claims herein which define the scope of the present invention.

Figure 1:
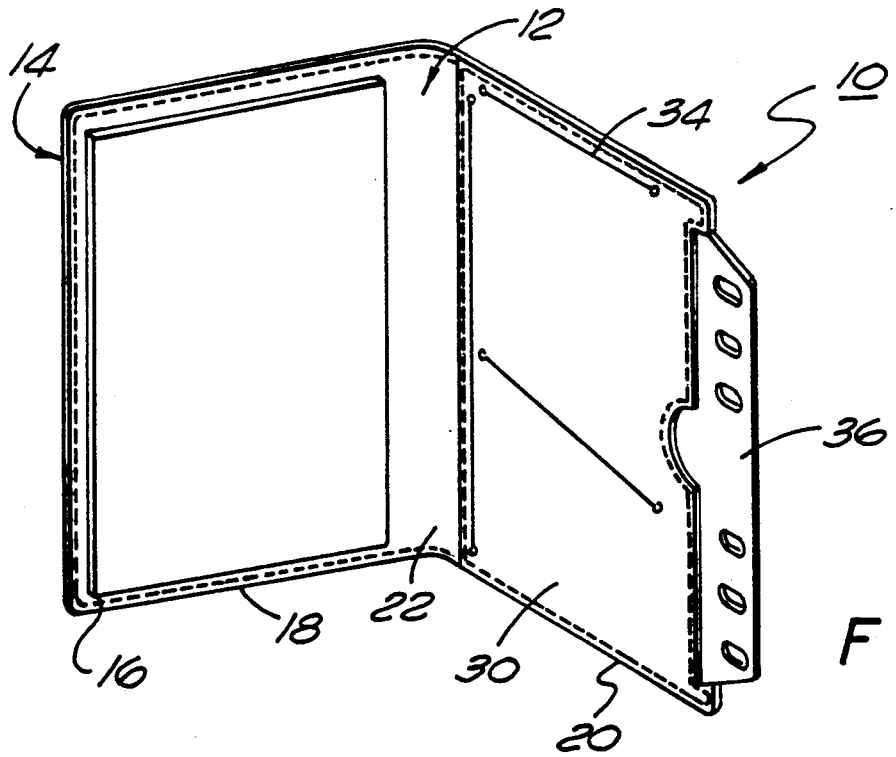
FIG. 1 is a perspective view of a pocket binder constructed in accordance with the present invention.

Referring to FIG 1, a preferred form of a pocket binder 10, constructed according to the present invention, has a cover 12 having an exterior panel 14 and an interior panel 16. The panels are foldable to form a first side 18, shown on the left side of FIG. 1, a second side 20, shown on the right side of FIG. 1, and a spine 22 positioned between the pocket binder sides. The first side 18 will be referred to as the front side 18 and the second side 20 will be referred to as the back side 20 for the purposes of clarity.

Figure 2:
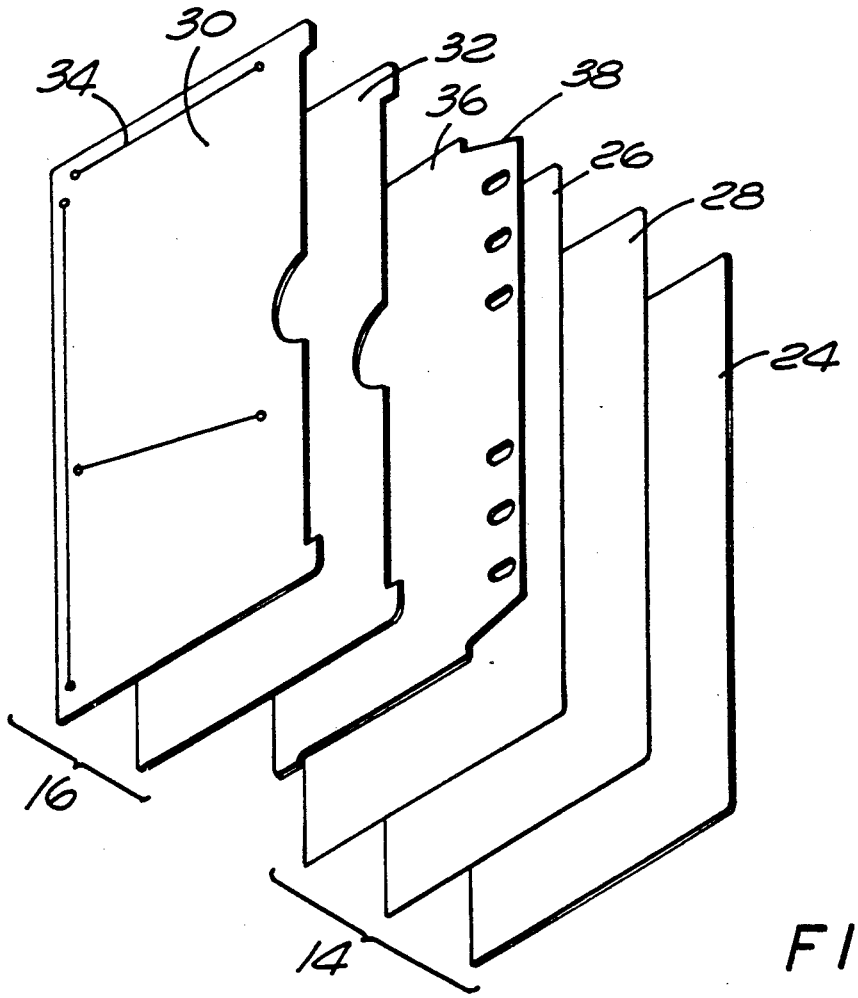
FIG. 2 is a fragmentary perspective view of the right cover, the ring mount and the pocket sheet of the present invention.

The back side 20 is shown in FIG. 2 to illustrate a preferred construction of the cover 12. The exterior panel 14 includes a leather sheet 24 on its external surface, and a first inner sheet 26 on its internal surface. A chipboard sheet 28 is sandwiched between the leather sheet 24 and the first inner sheet 26 to provide support. The interior panel 16 includes a pocket sheet 30 located on its external surface, the surface exposed in the interior of the pocket binder 10, and a second inner sheet 32. In a preferred embodiment, the first inner sheet 26, the pocket sheet 30 and the second inner sheet 32 are made of suedene.

As shown in FIG. 1, the peripheries of the exterior panel 14 and the interior panel 16 are joined together by stitching, heat sealing or other suitable means. In alternative embodiments, the pocket sheet 30 may be formed from a translucent plastic sheet that is superimposed over the second inner sheet 32 and heat sealed along their respective peripheries.

The pocket sheet 30 defines a pocket in the space between the pocket sheet 30 and the second inner sheet 32. As shown in FIGS. 1 and 2, openings may be provided in the pocket sheet 30 to provide access to the pocket. The purpose of these openings is to permit the user to removably affix a writing pad, checkbook or other article to the interior panel 16. For example, a pad of paper having a cardboard backing may be attached to the interior panel 16 by inserting the backing through a slot 34, shown at the top of the pocket sheet 30, so that the backing is held between the second inner sheet 32 and the pocket sheet 30, and the paper pad is accessible from the interior of the pocket binder 10. Other openings in the pocket sheet 30 serve a similar purpose as the slot 34.

As shown in FIG. 1, the back side 20 of the cover 12 has an opening along its outside longitudinal edge wherein the interior panel 16 is not joined to the exterior panel 14. The space between the exterior panel 14 and the interior panel 16 forms a compartment (not shown) that is accessible through the opening in the cover 12. In a preferred embodiment, the compartment is located in the space between the first inner sheet 26 of the exterior panel 14 and the second inner sheet 32 of the interior panel 16.

A ring mount 36 is slidably seated in the compartment with its outside longitudinal edge adjacent to the compartment opening and its inside longitudinal edge adjacent to the spine 22. The ring mount 36 has a first longitudinal portion 38 on its outside longitudinal edge that defines a plurality of holes 40 of such size, number and position for the holes 40 to be adapted for engagement with the rings of a conventional ringed binder. The ring mount 36 is slidably seated in the compartment such that it is in a retracted position when the ring mount 36 is fully seated within the compartment and in an extended position when a portion of the ring mount 36 is positioned outside of the compartment and the ring holes 40 are accessible for placement in a ringed binder.

Figure 3:
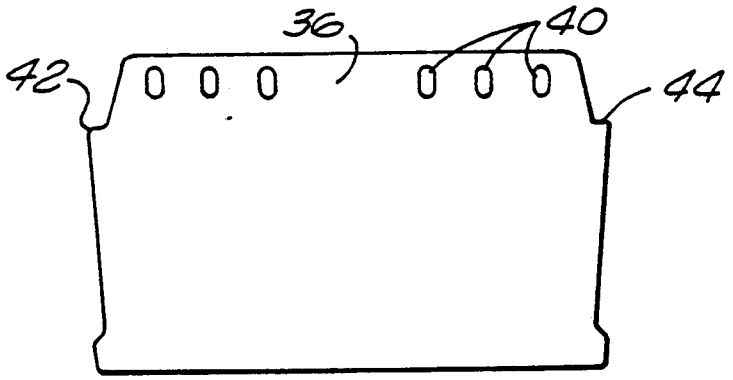
FIG. 3 is a plan view of the ring mount of the present invention.

A preferred embodiment of the ring mount 36 is illustrated in FIG. 3. The size and shape of the ring mount 36 are such that it substantially fills the interior of the compartment when the ring mount 36 is retracted. In this manner, the ring holes 40, located on the outside longitudinal edge of the ring mount 36, are substantially concealed by the interior panel 16 and the exterior panel 14 when the ring mount 36 is retracted into the compartment. Structurally, in a preferred embodiment, the ring mount 36 is stiff and substantially flat to provide support to the pocket binder and to provide a suitable writing surface.

Figure 4:
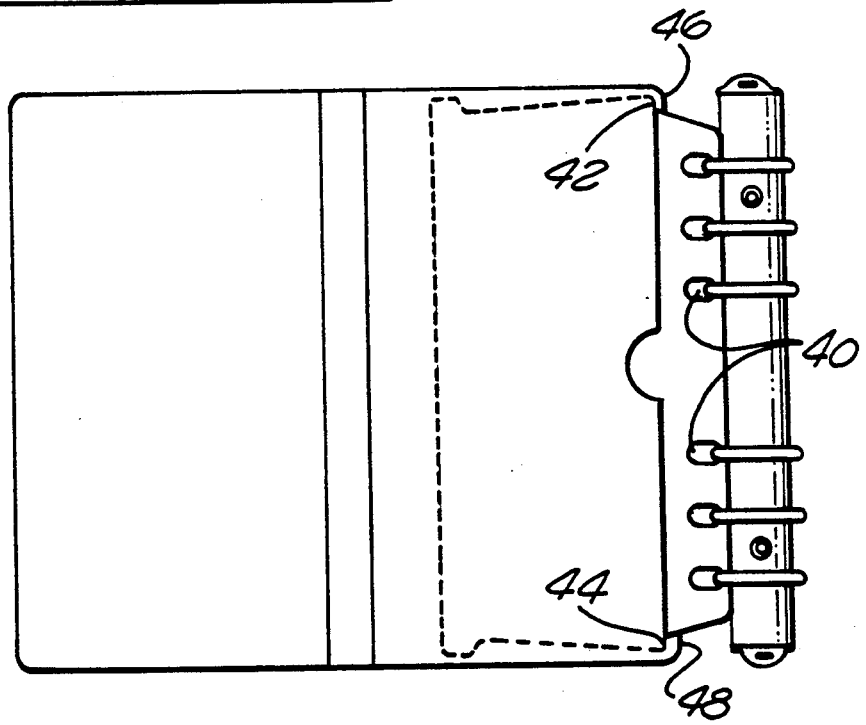
FIG. 4 is a plan view of the pocket binder of the present invention placed in the rings of a ringed binder and illustrating the position of the ring mount in the compartment.

FIGS. 3 and 4 illustrate a preferred arrangement for retaining the ring mount 36 in the compartment when the ring mount 36 is extended from the compartment. The ring mount 36 includes a first shoulder 42 and a second shoulder 44 located on opposing sides of the ring mount 36 to the outside of and behind the ring holes 40. To prevent the complete removal of the ring mount 36 from the compartment, the outside longitudinal edges of the back exterior panel and the back interior panel are partially joined at the ends of the opening to form a first flange 46 and a second flange 48. When the ring mount 36 is extended from the compartment, the shoulders 42 and 44 abut the flanges 46 and 48 within the interior of the compartment. This retains the portion of the ring mount 36 behind the shoulders 42 and 44 in the compartment even though a portion of it, including the ring holes 40, is extended from the compartment.

In alternative embodiments, other means may be used to retain the ring mount 36 in the compartment. For example, an elastic band may be attached to the inside longitudinal edge of the ring mount 36 and the inside longitudinal edge of the compartment.

Figure 5:
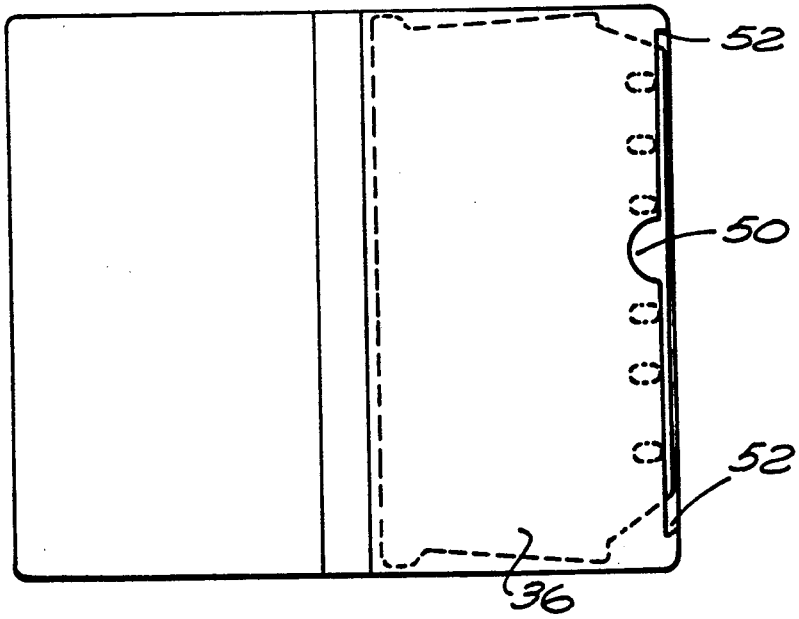
FIG. 5 is a plan view of the pocket binder of FIG. 4 illustrating position of the ring mount in the compartment when the mount is retracted.

In a preferred embodiment, a rectangular aperture is provided on the outside longitudinal edge of the interior panel 16 to delineate an opening 52 for the compartment. When the ring mount 36 is retracted into the compartment, only a small portion of the outside longitudinal edge of the ring mount 36 is accessible through the opening 52. To increase accessibility and to ease sliding of the ring mount 36 from a retracted position, as illustrated in FIG. 5, a cutout 50 is incorporated in the back interior panel 16. The cutout 50 is shown as a half circle and is located in the center of the outside longitudinal edge of the interior panel 16 as an enlargement to the opening 52, however, many different shapes and positions are possible. As shown, a portion of the retracted ring mount 36 extends underneath the cutout 50 and thereby allows the user to more readily grip the ring mount 36 and slide it out of the compartment to expose the ring holes 40.

FIG. 5 also illustrates a preferred size and shape of the ring mount 36 in relation to the size and shape of the compartment. The width of the ring mount 36 is less than the width of the compartment to permit the ring mount 36 to be fully seated in and thereby fully retracted into the compartment. As shown, when the ring mount 36 is fully retracted, the ring holes 40 are substantially concealed by the interior panel 16 and the exterior panel 14. This permits the present invention to retain its compact size when the ring mount 36 is retracted, yet still be connected to a ringed binder when the ring mount is partially extended from the compartment.

Figure 6:
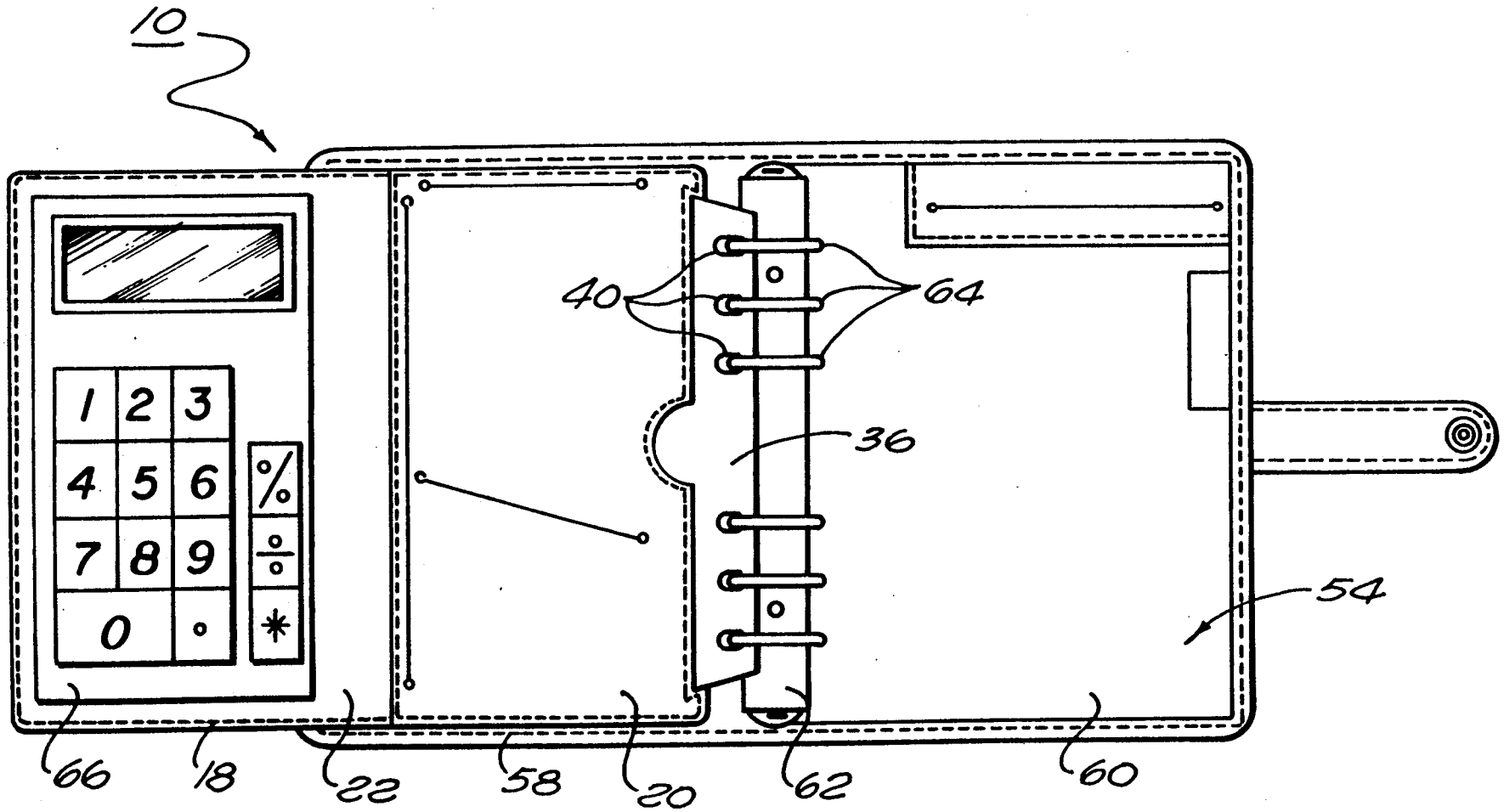
FIG. 6 is a plan view of a binder combination constructed in accordance with the present invention.

Referring to FIG. 6, a binder combination including a ringed binder 54 and the pocket binder 10 is shown. The ringed binder 54 is of a common variety having a cover 56 with a front side 58 and a back side 60 made from rigid, rectangular panels that are each hingedly connected along one edge to a spine 62. A plurality of similar openable metal rings 64 are located along the spine 62. A pocket binder 10 constructed according to the present invention is shown attached to the ringed binder 54 by threading the rings 64 of the ringed binder 54 through the ring mount holes 40.

In the embodiment shown in FIG. 6, a calculator 66 or other article may be mounted on the interior panel 16 of the pocket binder. As also shown in this embodiment, the width of the pocket binder 10, including the combined widths of the front side 18, the back side 20, the spine 22 and the ring mount 36, is greater than the width of the front side 58 of the ringed binder 54 when the pocket binder 10 is fully opened. In this manner, when the pocket binder 10 is opened, the front side 18 of the pocket binder 10 extends beyond the periphery of the front side 58 of the ringed binder 54 and the calculator 66 is accessible when the ringed binder 54 is closed.

Although described for the purposes of clarity with regard to specific preferred embodiments, the present invention is not limited to those embodiments but rather is applicable broadly to all versions falling within the scope and spirit of the appended claims. For example, while specific elements are be described in terms of their structural relationship to the front side or the back side, the present invention is also applicable to embodiments wherein those specific elements are structurally related to the opposite side than the side described. Accordingly, it is not a requirement of the present invention that the ring mount be slidingly received in a compartment formed in the back cover. Instead, the arrangement of elements shown in the drawings may be reversed, and the ring mount may also be slidingly received in a compartment formed in the front cover.

I claim:

1. A pocket binder adapted for use with a ringed binder having rings, comprising:

a cover having an exterior panel and an interior panel, the cover having a compartment formed between the exterior panel and the interior panel and an opening along a first longitudinal edge of the cover to provide access to the compartment;

a ring mount slidably seated within the compartment, the ring mount having a first longitudinal portion defining a plurality of holes adapted for engagement with the rings of the ringed binder when the first portion of the ring mount is extended from the compartment; and means for retaining a second portion of the ring mount in the compartment when the first portion of the ring mount is extended from the compartment.

2. The pocket binder of claim further comprising an article mounted on the interior panel.

3. The pocket binder of claim 1 wherein the width of the ring mount is less than the width of the compartment such that the holes of the ring mount are substantially concealed by the interior panel and the exterior panel when the ring mount is retracted into the compartment.

4. The pocket binder of claim 1 wherein the ring mount is stiff and substantially flat.

5. The pocket binder of claim 1 wherein the compartment opening further includes a cutout, defined by the interior panel, adapted to ease sliding of the ring mount from a retracted position in the compartment.

6. The pocket binder of claim 1 further comprising a pocket sheet overlying the interior panel and attached to the interior panel along its periphery to define a pocket between the pocket sheet and the interior panel, the pocket sheet having an opening therein to provide access to the pocket.

7. A pocket binder for use with a ringed binder having rings, comprising:

a cover having an exterior panel and an interior panel, the cover having a compartment formed between the exterior panel and the interior panel and an opening along a first longitudinal edge of the cover to provide access to the compartment;

the first longitudinal edge of the exterior panel and the first longitudinal edge of the interior panel being joined to form a first flange and a second flange at opposing ends of the longitudinal edges;

a ring mount slidably seated within the compartment, the ring mount having a first longitudinal portion defining a plurality of holes adapted for engagement with rings of a ringed binder when the first portion of the ring mount is extended from the compartment; and means for retaining a second portion of the ring mount in the compartment when the first portion of the ring mount is extended from the compartment, comprising (a) a first shoulder formed on a first side of the ring mount and a second shoulder formed on a second side of the ring mount;

(b) the first shoulder and the second shoulder being adapted to abut the first flange and the second flange, respectively, when the first portion of the ring mount is extended from the compartment opening.

8. The pocket binder of claim 7 further comprising an article mounted on the interior panel.

9. The pocket binder of claim 7 wherein the width of the ring mount is less than the width of the compartment such that the holes of the ring mount are substantially concealed by the interior panel and the exterior panel when the ring mount is retracted into the compartment.

10. The pocket binder of claim 7 wherein the ring mount is stiff and substantially flat.

11. The pocket binder of claim 7 wherein the compartment opening further includes a cutout, defined by the interior panel, adapted to ease sliding of the ring mount from a retracted position in the compartment.

12. The pocket binder of claim 7 further comprising a pocket sheet overlying the interior panel and attached to the interior panel along its periphery to define a pocket between the pocket sheet and the interior panel, the pocket sheet having an opening therein to provide access to the pocket.

13. A pocket binder, for use with a ringed binder having a cover with two sides and rings, comprising:

a cover having (a) a first side, a second side and a spine positioned between the sides, each cover side having an exterior panel and an interior panel;

(b) a width greater than the width of one side of the ringed binder; and (c) a compartment formed between the exterior panel and the interior panel and an opening along a first longitudinal edge of the cover to provide access to the compartment;

a ring mount slidably seated within the compartment, the ring mount having a first longitudinal portion defining a plurality of holes adapted for engagement with the rings of the ringed binder when the first portion of the ring mount is extended from the compartment; and means for retaining a second portion of the ring mount in the compartment when the first portion of the ring mount is extended from the compartment.

14. The pocket binder of claim 13 further comprising an article mounted on the interior panel.

15. The pocket binder of claim 13 wherein the width of the ring mount is less than the width of the compartment such that the holes of the ring mount are substantially concealed by the interior panel and the exterior panel when the ring mount is retracted into the compartment.

16. The pocket binder of claim 13 wherein the ring mount is stiff and substantially flat.

17. The pocket binder of claim 13 wherein the compartment opening further includes a cutout, defined by the interior panel, adapted to ease sliding of the ring mount from a retracted position in the compartment.

18. The pocket binder of claim 13 further comprising a pocket sheet overlying the interior panel and attached to the interior panel along its periphery to define a pocket between the pocket sheet and the interior panel, the pocket sheet having an opening therein to provide access to the pocket.

19. A binder combination comprising:

a ringed binder with openable rings; and a pocket binder, having (a) a cover having an exterior panel and an interior panel and a compartment formed between the exterior panel and the interior panel and an opening along a first longitudinal edge of the cover to provide access to the compartment;

(b) a ring mount slidably seated within the compartment, the ring mount having a first longitudinal portion defining a plurality of holes adapted for engagement with rings of a ringed binder when the first portion of the ring mount is extended from the compartment; and (c) means for retaining a second portion of the ring mount in the compartment when the first portion of the ring mount is extended from the compartment.

20. The binder combination of claim 19 further comprising an article mounted on the interior panel of the pocket binder.

21. The binder combination of claim 19 wherein the width of the ring mount is less than the width of the compartment such that the holes of the ring mount are substantially concealed by the interior panel and the exterior panel when the ring mount is retracted into the compartment.

22. The binder combination of claim 19 wherein the ring mount is stiff and substantially flat.

23. The binder combination of claim 19 wherein the compartment opening further includes a cutout, defined by the interior panel, adapted to ease sliding of the ring mount from a retracted position in the compartment.

24. The binder combination of claim 19 further comprising a pocket sheet overlying the interior panel of the pocket binder and attached to the interior panel along its periphery to define a pocket between the pocket sheet and the interior panel, the pocket sheet having an opening therein to provide access to the pocket.

* * * * *

UNITED STATES PATENT AND TRADEMARK OFFICE

CERTIFICATE OF CORRECTION

PATENT NO. : 5,186,565

DATED : February 16, 1993

INVENTOR(S) : Douglas M. Jack

It is certified that error appears in the above-identified patent and that said Letters Patent is hereby corrected as shown below:

Col. 2, line 49, after "illustrating" insert -- the --;

Col. 5, line 52, after "claim" insert -- 1 --.

Signed and Sealed this

Twenty-third Day of November, 1993

*Attest:*

Bruce Lehman

BRUCE LEHMAN

*Attesting Officer*

*Commissioner of Patents and Trademarks*